US009384727B2

(12) United States Patent
Booij et al.

(10) Patent No.: US 9,384,727 B2
(45) Date of Patent: Jul. 5, 2016

(54) ACTIVE SOUND REDUCTION SYSTEM AND METHOD

(75) Inventors: Paul Sebastian Booij, The Hague (NL); Adriaan Johan Van Leest, Eindhoven (NL); Ronaldus Maria Aarts, Geldrop (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 619 days.

(21) Appl. No.: 13/387,763

(22) PCT Filed: Jul. 30, 2010

(86) PCT No.: PCT/IB2010/053472

§ 371 (c)(1),
(2), (4) Date: Mar. 20, 2012

(87) PCT Pub. No.: WO2011/015979

PCT Pub. Date: Feb. 10, 2011

(65) Prior Publication Data

US 2012/0163626 A1 Jun. 28, 2012

(30) Foreign Application Priority Data

Aug. 7, 2009 (EP) ..... 09167433

(51) Int. Cl.
*G10K 11/16* (2006.01)
*G10K 11/178* (2006.01)

(52) U.S. Cl.
CPC ..... *G10K 11/1788* (2013.01)

(58) Field of Classification Search
CPC ..... G10K 11/178
USPC ..... 381/71.1–71.7, 71.11–71.12, 92
See application file for complete search history.

(56) References Cited

U.S. PATENT DOCUMENTS 5,844,996 A * 12/1998 Enzmann ..... A61B 5/7475 381/71.11
8,325,934 B2 * 12/2012 Kuo ..... A47C 21/003 381/71.6

(Continued)

FOREIGN PATENT DOCUMENTS

DE 19706645 A1 9/1998
DE 202005004450 U1 5/2005

(Continued)

*Primary Examiner* — Disler Paul
(74) *Attorney, Agent, or Firm* — Larry Liberchuk

(57) ABSTRACT

The present invention refers to an active sound reduction system and method for attenuation of sound emitted by a primary sound source, especially for attenuation of snoring sounds emitted by a human being. This system comprises a primary sound source, at least one speaker as a secondary sound source for producing an attenuating sound to be superposed with the sound emitted by said primary sound source, a reference microphone for receiving sound from said primary sound source, and at least one error microphone being allocated to each speaker to form a speaker/microphone pair. The at least one error microphone is provided as a directional microphone pointing at its allocated speaker to receive residual sound resulting from the superposition of the sounds from the primary sound source and the corresponding speaker. The error microphone and speaker of at least one speaker/microphone pair and the primary sound source are arranged substantially collinear. A control unit is provided to receive an output reference signal of the reference microphone representing the sound received by the reference microphone and an output error signal of the at least one error microphone representing the sound received by the at least one error microphone and to calculate a control signal for the speaker from the output reference signal and the output error signal.

19 Claims, 3 Drawing Sheets

(56) References Cited

U.S. PATENT DOCUMENTS

2003/0103635 A1* 6/2003 Wright ..... G10K 11/1786 381/71.8
2004/0234080 A1 11/2004 Hernandez
2008/0304677 A1* 12/2008 Abolfathi ..... G10K 11/1788 381/71.1
2009/0147965 A1* 6/2009 Kuo ..... A47C 21/003 381/71.6
2010/0283618 A1* 11/2010 Wolfe ..... A61B 7/003 340/575

FOREIGN PATENT DOCUMENTS

WO 2007066259 A2 6/2007
WO 2009073671 A1 6/2009

* cited by examiner

ACTIVE SOUND REDUCTION SYSTEM AND METHOD

FIELD OF THE INVENTION

The present invention relates to an active sound reduction system for attenuation of sound emitted by a primary sound source, especially for attenuating snoring sounds emitted by a human being, and to a corresponding active sound reduction method.

BACKGROUND OF THE INVENTION

Active sound reduction systems exist in various technical implementations in different fields wherever it is desired to cancel noise or any undesired sound emissions of a primary sound source. The term "active" refers to any means which can react to the sound to be cancelled, providing a number of advantages over passive means like insulating mats, noise-absorbent walls or casings etc. The most common active sound reduction system is the so-called Active Noise Control (ANC) which aims at canceling unwanted noise by introducing an additional sound field that destructively interferes with the original noise from the primary sound source. This additional sound wave is sometimes referred to as "anti-noise". Provided that amplitude and phase of the anti-noise field are matched to the noise emitted by the primary sound source, the residual sound resulting from the superposition of the sounds from the primary sound source and the secondary sound source generating the anti-noise should be cancelled completely. Although the basic idea of active noise control has already been developed over some decades, serious successful applications are few. The reason is that the theoretical principle of canceling noise by anti-noise is not often successful in practice, since there is a number of determining conditions which are often not fulfilled. Just to mention one example, reflections of the sound emitted by the primary sound source also have to be cancelled to extinguish the original sound completely, which can only be achieved by great operation expense and effort.

In recent years the research has been concentrated on applications offering well-defined conditions to use an active sound reduction system of the above kind successfully. One example for such an application is the cancellation of snoring sounds emitted by a human being, which can be a major nuisance for a sleeping partner. The sound associated with snoring is caused by the vibration of a part of the upper respiratory tract. This vibration can occur in the soft palate, tongue, tonsils or epiglottis, of which palatal snoring is by far the most common. In ten percent of snorers, the upper airway suffers a partial or full collapse, resulting in cessation of respiratory airflow which leads to premature arousal from sleep. If this obstruction lasts at least ten seconds and happens repeatedly, the snorer suffers from Obstructive Sleep Apnea (OSA). This serious condition is associated with hypertension, ischemic heart disease and stroke, as well as industrial accidents, driving fatalities and lost productivity due to daytime sleepiness. It results from the above that snoring is more than an annoyance but also represents a serious medical problem which is very common in the general population.

There have been attempts to apply Active Noise Control (ANC) for the attenuation of snoring sounds emitted by a human being in a typical environment like a bedroom. U.S. Pat. No. 5,844,996 refers to an active electronic noise suppression system and a corresponding method for reducing snoring noise, using a reference microphone mounted above the snoring person for receiving the sound from this person as a primary sound source, and a number of error microphones which are arranged to receive the residual sound resulting from the superposition of the sounds from the snorer and a speaker which generates an attenuating sound which is superposed with the sound emitted by the snorer. The speaker is controlled according to a reference signal corresponding to the sound received by the reference microphone and an output error signal received by the error microphone, corresponding to the residual sound. The system aims at attenuating the residual sound to zero so that the noise in the area wherein the error microphone is located is cancelled completely. With other words, the control signal for the speaker producing the attenuating sound is calculated by processing the reference signal by the reference microphone in such a way that the residual signal will be minimized, to create a "quiet zone" in a certain area wherein a sleeping partner is located.

Like other applications, the above mentioned application of active noise control suffers from certain deficiencies, coursed by the preconditions given by the environment, like reflections of the walls and so on. One resulting problem is that a quiet zone, which is desired to be as large as possible, is very small. The reason is that the phase opposition, which is a condition for cancellation of the primary and secondary sound, is lost easily when the bed partner moves in any direction, causing a phase mismatch. As the movements of a human being in sleep are not controllable, there is no practical way to keep the sleeping partner within a very small quiet zone generated by the known ANC-System. The effectivity of this system is therefore small, as well as its usefulness in practice.

It is therefore an object of the present invention to improve the effectivity of an active sound reduction system and method as described above. Stated more precisely, one object of the present invention lies in providing a system and method for active sound reduction which enlarges the size the quiet zone in which optimal attenuation of the sound emitted by the snorer takes place.

SUMMARY OF THE INVENTION

This object is achieved by an active sound reduction system comprising the features of claim 1, as well as by an active sound reduction method comprising the features of claim 9.

The active sound reduction system according to the present invention comprises at least one speaker as a secondary sound source for producing an attenuating sound, a reference microphone for receiving sound from the primary sound source and at least one error microphone which is allocated to the speaker. One speaker and one error microphone form a pair which will be referred to as speaker-microphone pair in the following description. A control unit for controlling the speaker is provided to calculate a control signal from the reference signal which is outputted by the reference microphone and the error signal which is outputted by the at least one error microphone, so that the speaker can be controlled to produce an attenuating sound to be superposed with the sound emitted by the primary sound source for maximum attenuation.

The error microphone is provided as a directional microphone with a strong directivity, i.e. receiving sound primarily from one determined direction. In this direction, the speaker is arranged which is allocated to the microphone to form a speaker/microphone pair. With other words, error microphone and speaker of one speaker/microphone pair are arranged so that the directional error microphone points at its allocated speaker.

Moreover, the error microphone and speaker of at least one speaker/microphone pair and the primary sound source are arranged substantially collinear.

By this arrangement the quiet zone as explained above can be created as large as possible, preventing a sleeping partner of a snorer acting as a primary sound source from leaving the quiet zone easily. By this measure the active sound reduction can be carried out in a more effective way.

The enlargement of the quiet zone is based on the finding that in a collinear arrangement of primary sound source, speaker and error microphone, the desired phase opposition between primary sound source and secondary sound source (i.e. the speaker) is not easily lost when the bed partner moves in any direction. Instead of optimizing the attenuation at one point, which is generally the case in conventional active noise control systems, an active wavefront cancellation takes place in a larger area around a point with optimal noise canceling by ideal phase opposition of the primary and secondary sound source. This arrangement can be further optimized by placing the secondary sound source near the primary sound source, compared to the distance between the error microphone and the primary sound source.

Using directional microphones as error microphones helps to discriminate various directions for different speaker/microphone pairs, which helps to optimize the cancellation results under typical environmental conditions. In a bedroom situation, there is an infinite amount of wavefronts, entering from an infinite amount of directions. Therefore a larger number of secondary sound sources improves the system according to the present invention.

According to a preferred embodiment of the present invention, the primary sound source is located between the error microphone and the speaker of a speaker/microphone pair which is arranged substantially collinear with the primary sound source.

In this arrangement the wavefronts from the primary sound source reach the error microphone earlier than the wavefronts by the respective speaker. Therefore the sound by the primary sound source has to be predicted as good as possible. This prediction can be performed as linear prediction, since a typical snoring sound has periodic parts which repeat with in certain time windows, making a prediction possible.

According to another preferred embodiment, the active sound reduction system according to the present invention comprises a number of error microphones grouped together within an area in which the primary sound source is located, further comprising a number of speakers being arranged around said area to form speaker/microphone pairs together with said error microphones.

Preferably said area is represented by the lying surface of a bed, the error microphones being grouped on or above said lying surface, their corresponding speakers being arranged at the edge portions of the bed.

In a preferred embodiment, the system comprises four error microphones and four speakers arranged at four different sides of the bed.

According to another preferred embodiment, the error microphones are integrated in a pillow.

Another preferred embodiment comprises at least one sound source to provide an additional masking sound for masking the sound emitted by the primary sound source.

This sound source to produce an additional masking sound can be represented by one of the speakers of the speaker/microphone pairs.

The controller unit of the system according to the present invention preferably is provided for identifying a predictable portion of the output reference signal and to produce a control signal corresponding to the predictable portion.

An active sound reduction method according to the present invention for attenuating sound emitted by a primary sound source, especially for attenuating snoring sounds emitted by a human being, comprises the steps of providing at least one speaker as a secondary sound source for producing an attenuating sound to be superposed with the sound emitted by the primary sound source, allocating at least one error microphone to each speaker to form a speaker/microphone pair, said at least one error microphone being provided as a directional microphone pointed at its allocated speaker for receiving residual sound resulting from the superposition of the sounds from the primary sound source and the speaker, arranging the at least one error microphone and the speaker of at least one speaker/microphone pair substantially collinear with said primary sound source, receiving sound from said primary sound source as a reference sound, calculating a control signal from an output reference signal corresponding to the reference sound and from an output error signal corresponding to the residual sound, and controlling the speaker by means of the control signal.

A preferred embodiment of this method comprises arranging the primary sound source between the error microphone and the speaker of the speaker/microphone pair arranged substantially collinear with the primary sound source.

Another preferred embodiment comprises grouping a number of error microphones within an area in which the primary sound source is located, and arranging the speakers allocated to said error microphones around said area.

Preferably the active sound reduction method according to the present invention comprises grouping a number of error microphones on or above the lying surface of a bed and arranging the speakers at the edge portions of the bed.

Preferably this method comprises arranging four error microphones on or above the lying surface of the bed and arranging four speakers at four different sides of the bed.

According to a preferred embodiment of this method, a predictable portion of the output reference signal is identified and a control signal corresponding to the predictable portion is produced. This predictable portion can be represented by a periodic portion of the snoring sound.

Another preferred of this method embodiment comprises producing an additional masking sound for masking the sound emitted by the primary sound source.

Further aspects and benefit of the present invention will become apparent from the detailed description provided hereinafter. It should be understood that the detailed description and specific examples, via indicating exemplary embodiments of the invention, are intended for purposes of illustration only and are not intended to limit the scope of the invention.

BRIEF DESCRIPTION OF THE DRAWINGS

The above mentioned features, aspects and advantages of the present invention will become better understood from the following description with reference to the accompanying drawings where.

DETAILED DESCRIPTION OF EMBODIMENTS

Figure 1:
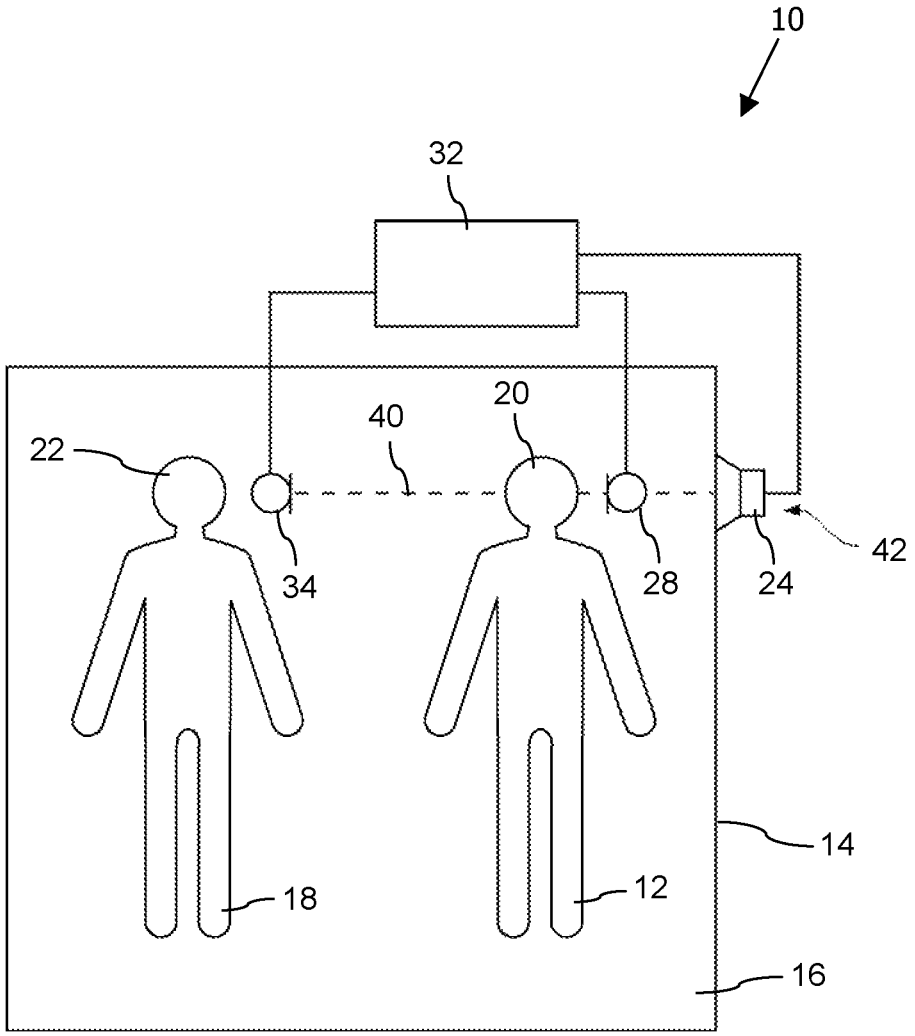
FIG. 1 is a schematic view of a first embodiment of an active sound reduction system according to the present invention.

In FIG. 1, an active sound reduction system generally marked by reference number 10 is depicted, for attenuation of a snoring sound emitted by a human being 12 as a primary sound source. The system 10 comprises a bed 14 with a lying surface like a mattress being substantially rectangular. In FIG. 1, the lying surface 16 is viewed from above, the human being 12 representing the primary sound source lying on the right side of the bed 14. On the left side of the bed 14, a second human being 18 is lying next to the first human being 12. It is assumed that the first human being 12 produces snoring sounds which are emitted from the head 20 of the first human being 12 in all directions. The active sound reduction system 10 serves to attenuate the sounds emitted from the first human being 12 at the position at the ears of the head 22 of the second human being 18 as high as possible, creating a quiet zone in the area wherein the head 22 of the second human being 18 is located.

The active sound reduction system 10 further comprises a speaker 24 arranged on the right side of the bed 14 at the edge of the lying surface 16. The speaker 24 is directed towards the lying surface 16, i.e. towards the two human beings 12, 18 lying on the bed 14. A reference microphone 28 is located near the head 20, especially the mouth of the first human being to receive snoring sounds from the primary sound source. The reference microphone 28 is connected with a control unit 32 depicted schematically, said control unit 32 being provided to receive an output reference signal by the reference microphone 28 which represents the sound received by the reference microphone 28.

A second microphone 34 is arranged at a position near the ear of the second human being 18, said second microphone 34 being an error microphone to receive a residual sound resulting from the superposition of sounds emitted by the primary sound source 12 and the speaker 24 as a secondary sound source. Like the reference microphone 28, the error microphone 34 is connected to the control unit 32 by a suitable wiring to send an output error signal representative for the residual sound received by the error microphone 34 to the control unit 32. The control unit 32 produces a control signal to control the speaker 24, said control signal being sent to the speaker 24 via a wiring. This control signal for controlling the speaker 24 is calculated from the output reference signal from the reference microphone 28 and from the output error signal received from the error microphone 34.

With other words, the control signal for the speaker as the secondary sound source is calculated based on two inputs, namely the reference signal required by the reference microphone 28, and a residual signal required by the error microphone 34. As the reference signal should be an accurate recording of the sound, i.e. the snoring, emitted by the first human being 12 as the primary sound source, the reference microphone 28 should be placed closely to the head 20 of the human being 12. On the other hand, the error microphone 34 should be placed as close to the ears of the second human being 18 as possible. The control signal for the speaker 24 is calculated in such a way that the residual signal is minimized, which means that a "quiet state" is reached, wherein the sounds of the primary and the secondary sound source cancel each other at the position of the error microphone 34.

To create a quiet zone in the area in which the error microphone 34 and the head 22 of the second human being 18 are positioned, the error microphone 34, the speaker 24 and the primary sound source, i.e. the first human being 12 are arranged collinear on a line marked by reference number 40 in FIG. 1. The error microphone 34 is provided as a directional microphone pointing at the speaker 24 so that sound coming from the direction of the speaker 24 is received by the error microphone 34. The directional error microphone 34 and the speaker 24 form a speaker/microphone pair 42, the two components of the pair 42 being arranged on the line 40 on which the primary sound source is located in a collinear fashion.

It has turned out that this collinear arrangement of the error microphone 34, the primary sound source 12 and the corresponding allocated speaker 24 optimizes the size of the quiet zone in which the error microphone 34 is located. This is because wavefronts arriving at the location of the error microphone 34 being emitted by the primary sound source 12 and the speaker 24 as the secondary sound source can be cancelled easily over a larger area. The desired phase opposition between the wavefronts by the primary and secondary sound sources 12 and 24 is maintained over the larger area. For example, the second human being 18 can move along the wavefronts so that the desired phase opposition will be kept. In the case shown in the first embodiment according to FIG. 1, wherein the primary sound source 12 is located between the error microphone 34 and the speaker 24 of one speaker/microphone pair 42, the quiet zone has the form of a phase match cone. The best results are achieved by keeping the secondary source as close to the primary source as possible.

It is noted in this context that a precise collinear arrangement leads to the best results, as the quiet zone is optimized in this case. However, small deviations from the collinear arrangement are still acceptable to achieve a quiet zone that is sufficiently large.

The first embodiment of the active sound reduction system 10 in FIG. 1 already achieves good results in attenuating the sound emitted directly from the primary sound source 12. However, in a practical bedroom situation, reflections on walls and objects have to be taken into account. The resulting wavefronts contribute to the noise level which is achieved at the location of the second human being 18, so that the system 10 of FIG. 1 can be further developed to compensate further wavefronts. Such a further development is represented by the system 50 according to FIG. 2, comprising additional speaker/microphone pairs 52, 54, 56 corresponding to a speaker/microphone pair 42 as depicted in FIG. 1. In total, four speaker/microphone pairs 42, 52, 54, 56 are present in the system 50. As the system 50 mainly represents a further development of the system 10 in FIG. 1, the same reference numbers have been used throughout the description and the drawings for identical parts. Correspondingly, the speaker/microphone pair 42 comprises a speaker 24 and an error microphone 34 arranged collinear with the primary sound source 12. Further error microphones 58, 60, 62 are directional microphones pointing to the respective speakers 64, 66, 68 allocated to these microphones 58, 60, 62. That is, one error microphone 58 is directed to a speaker 64 arranged at the head side of the bed 14, one further error microphone 60 is pointing in the direction of the second human being 18 towards a further speaker 66 at the side of the bed 14 opposite to the side where the speaker 24 is located, and one error microphone 62 is pointing toward the foot side of the bed where the speaker 68 is located.

While the speakers 24, 64, 66, 68 are arranged at the edges of the lying surface 16 of the bed 14, the corresponding four error microphones are grouped together in a small area between the first human being 12 and the second human being 18 near the ears of the second human being 18, pointing in different directions. The four error microphones 34, 58, 60, 62 can be integrated in a pillow. The strong directionality of the directional microphones 34, 58, 60, 62 makes it possible to discriminate the various directions of the different wavefronts creating the snoring sound which shall be attenuated.

Each speaker 24, 64, 66, 68 of the system 50 is controlled by an own control signal which is calculated based only on the wavefronts which it has to cancel. This is the reason why the error microphones 34, 58, 60, 62 have to acquire a directional information on the sound intensity that they measure. So-called first order microphones can be used for the error microphones 34, 58, 60, 62 to achieve the desired directionality of the sound measurement.

Figure 3:
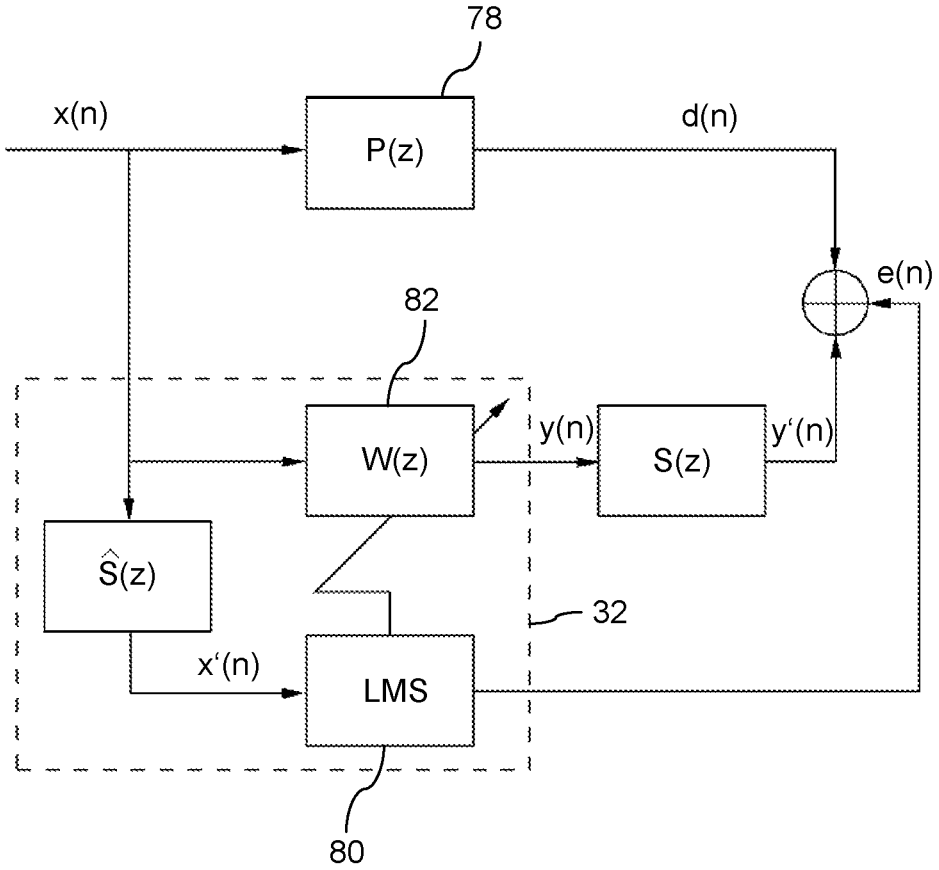
FIG. 3 is a diagram showing the signal flow for an active sound reduction system according to the present invention.

As described in connection with the system 10 in FIG. 1, the output error signals of the four error microphones 34, 58, 60, 62 are transferred to a control unit 32, as well as the output reference signal from the reference microphone 28. The signal paths of the four error microphones 34, 58, 60, 62 are completely independent from each other so that a four-channel system is created. FIG. 3 shows the signal flow for an active sound reduction system 10, 50 in a simplified form. In principle, the signal flow for a one-channel system 10 can be generalized to a four-channel system 50 so that the following description in view of FIG. 3 implies some simplifications.

In FIG. 3, the sound signal x(n) from the primary sound source propagates through the primary path P(z) 78 to one error microphone, where the air pressure of the sound wave is denoted as d(n). Based on the error measurement e(n) and the perfect reference signal x(n) an algorithm (denoted schematically by reference number 80) updates an adaptive filter W(z) (reference number 82). In this embodiment, the algorithm is a so-called LMS algorithm (for least means squares algorithm), although other suitable types of algorithms can be used. Filter W(z) 82 is used to filter the signal x(n) resulting in control signal y(n) that traverses the secondary path S(z) to arrive at the error microphone where it is denoted y'(n). The secondary path S(z) is the path between the control signal y(n) and error signal e(n) and includes the secondary source transfer function (amplifier and speaker), the acoustic path between secondary source and error microphone, the error microphone transfer function and all necessary conversions between the analog and digital domains.

Signal x(n) is also inputted into the control unit 32 (marked by a broken line in FIG. 3) to be filtered by the filter W(z) 82 and to be used as an input for the LMS algorithm 80. To take into account that S(z) is generally unknown, an estimate $\hat{S}(z)$ is used with an impulse response $\hat{s}(n)$ so that only the filter signal x'(n) is used by the LMS algorithm 80 instead of the ideal signal x(n).

Figure 2:
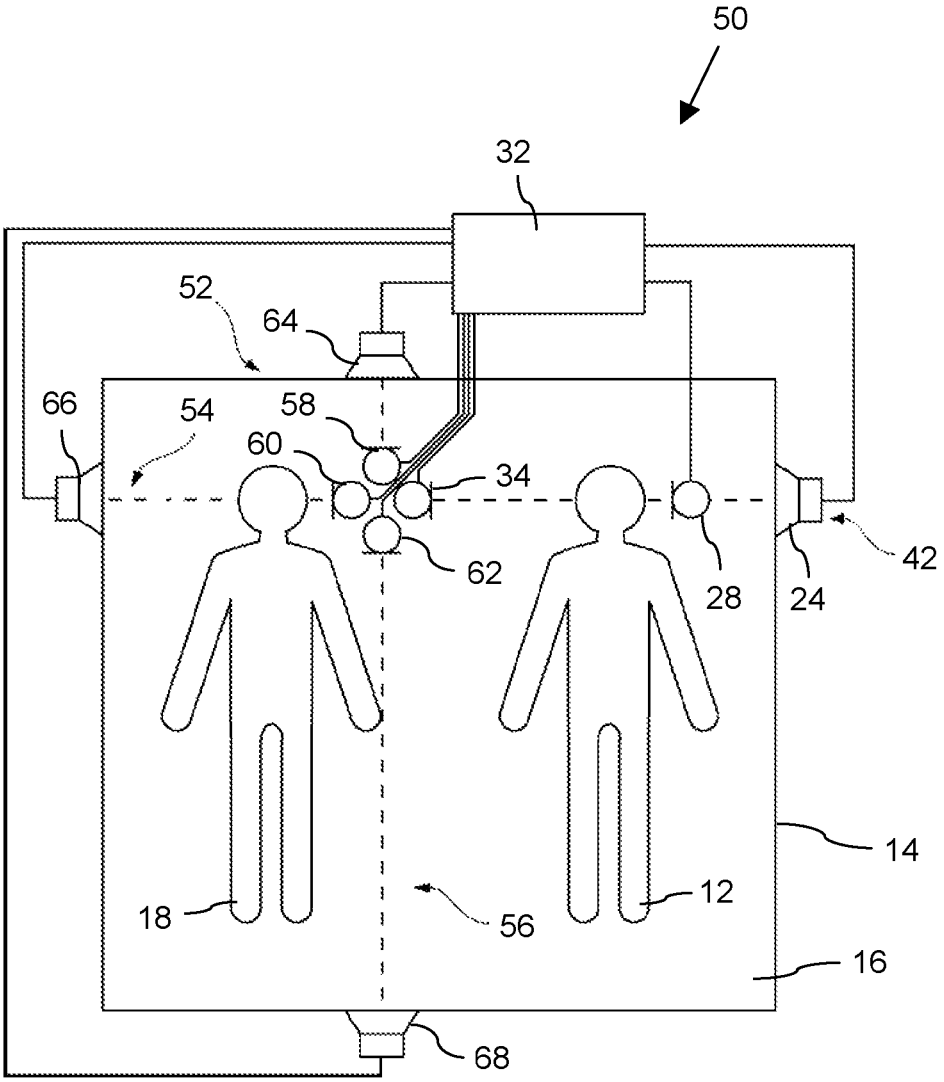
FIG. 2 is a schematic view according to FIG. 1, showing a second embodiment of an active sound reduction system according to the present invention.

In a multi-channel situation, the signal flow principle as shown in FIG. 3 can be applied to a number of K secondary sources and K error microphones. As a real-time calculation may be difficult in these cases, simplifications in the LMS algorithm 80 can be made to conclude the respective signal for the speakers. In FIG. 2, it is shown, that the control signals are transferred from the control unit 32 to the speakers 24, 64, 66, 68 by corresponding lines, as shown in principle in connection with FIG. 1.

Various modifications of the system as described above can be made. For example, a masking sound for masking the sound of the primary sound can be produced by a sound source. This sound source can be rendered by at least one of the speakers 24, 64, 66, 68 of the speaker/microphone pairs 42, 52, 54, 56 or by additional sound sources. In another example, the system provides functions for recording a history of the system functions which can be stored in a memory, so that a sleeper or a physician supervising the sleeper can retrieve any desired information about the snoring behaviour at a later point in time. This logging function can be performed by the control unit 32.

The above description is intended to be merely illustrative of the present invention and should not be construed as limiting the appended claims to any particular embodiment or group of embodiments. While the invention has been described in detail with reference to specific exemplary embodiments thereof, different modifications and changes can be made thereto without departing from the spirit and scope of the invention as set forth in the claims. The specification and drawings are accordingly to be regarded in an illustrative manner and are not intended to limit the scope of the claims. In the claims, the word "comprising" does not exclude other elements or steps, and the indefinite article "a" or "an" does not exclude a plurality. Any reference signs in the claims should not be construed as limiting this scope.

The invention claimed is:

1. An active sound reduction system for attenuation of sound emitted by a primary sound source, the system comprising:

a speaker used as a secondary sound source to produce an attenuating sound that superposes the sound emitted by the primary sound source;

a reference microphone to receive the sound emitted by the primary sound source;

an error microphone being a directional microphone allocated and pointing to the speaker to form a speaker/microphone pair, the error microphone being configured to receive a residual sound resulting from a superposition of the primary and attenuating sounds, the error microphone being located in a quiet zone spaced apart from the primary sound source;

the error microphone, the speaker and the primary sound source being arranged substantially collinear; and a control unit configured to receive an output reference signal from the reference microphone representing the sound received by the reference microphone and receive an output error signal from the error microphone representing the sound received by the error microphone, and further configured to calculate a control signal based on the output reference signal and the output error signal in order to control the speaker using the control signal such that the quiet zone is created.

2. The active sound reduction system according to claim 1, wherein the primary sound source is located between the error microphone and the speaker of the speaker/microphone pair which is arranged substantially collinear with the primary sound source.

3. The active sound reduction system according to claim 1, comprising:

a number of error microphones grouped together within an area in which the primary sound source is located, and a number of speakers arranged around the area to form speaker/microphone pairs together with the number of error microphones.

4. The active sound reduction system according to claim 3, wherein the area is represented by a lying surface of a bed, the number of error microphones being grouped on or above the lying surface, their corresponding speakers forming the speaker/microphone pair being arranged at edge portions of the bed.

5. The active sound reduction system according to claim 4, further comprises four error microphones and four speakers arranged at four different sides of the bed.

6. The active sound reduction system according to claim 3, wherein the error microphones are integrated in a pillow.

7. The active sound reduction system according to claim 1, wherein at least one other sound source provides an additional masking sound for masking the sound emitted by the primary sound source.

8. The active sound reduction system according to claim 1, wherein the control unit is configured to identify a predictable portion of the output reference signal and to produce a control signal corresponding to the predictable portion.

9. The active sound reduction system according to claim 1, wherein the speaker is configured at a distance near the primary sound source as compared to the distance between the error microphone and the primary sound source in the collinear arrangement.

10. The active sound reduction system according to claim 9, wherein the system is configured to form the primary sound source to be located between the error microphone and the speaker of the speaker/microphone pair which is arranged substantially collinear with the primary sound source, causing wavefronts from the primary sound source to reach the error microphone earlier than the wavefronts of the speaker forming the speaker/microphone pair.

11. An active sound reduction method for attenuating sound emitted by a primary sound source, the method comprising:

producing, by a speaker, an attenuating sound that superposes the sound emitted by the primary sound source, forming a speaker/microphone pair by allocating an error microphone to the speaker, the error microphone being provided as a directional microphone pointing at the speaker forming the speaker/microphone pair, the error microphone being located in a quiet zone spaced apart from the primary sound source, receiving, by the error microphone, residual sound resulting from a superposition of sounds from the primary sound source and the speaker, arranging the error microphone and the speaker substantially collinear with the primary sound source, receiving sound from the primary sound source as a reference sound, calculating a control signal based on an output reference signal corresponding to the reference sound and an output error signal corresponding to the residual sound, and controlling the speaker using the control signal such that the quiet zone is created.

12. The active sound reduction method according to claim 11, further comprising arranging the primary sound source between the error microphone and the speaker of the speaker/microphone pair substantially collinear with the primary sound source.

13. The active sound reduction method according to claim 11, further comprising:

grouping a number of error microphones within an area in which the primary sound source is located, and arranging speakers allocated to the number of error microphones around the area.

14. The active sound reduction method according to claim 13, further comprising grouping a number of error microphones on or above a lying surface of a bed and arranging the speakers at edge portions of the bed.

15. The active sound reduction method according to claim 14, further comprising four error microphones arranged on or above the lying surface of the bed and four speakers arranged at four different sides of the bed.

16. The active sound reduction method according to claim 11, further comprising identifying a predictable portion of the output reference signal and to produce a control signal corresponding to the predictable portion.

17. The active sound reduction method according to claim 11, further comprising producing an additional masking sound for masking the sound emitted by the primary sound source.

18. The active sound reduction method according to claim 11, wherein the speaker is configured at a distance near the primary sound source as compared to the distance between the error microphone and the primary sound source in a collinear arrangement.

19. The active sound reduction method according to claim 18, wherein the primary sound source is located between the error microphone and the speaker of the speaker/microphone pair which is arranged substantially collinear with the primary sound source, causing wavefronts from the primary sound source to reach the error microphone earlier than the wavefronts of the speaker forming the speaker/microphone pair.

* * * * *